US006911775B2

(12) United States Patent
Kanzaki et al.

(10) Patent No.: US 6,911,775 B2
(45) Date of Patent: Jun. 28, 2005

(54) SHORT-ARC, ULTRA-HIGH PRESSURE DISCHARGE LAMP

(75) Inventors: Yoshitaka Kanzaki, Himeji (JP); Masanobu Komiya, Himeji (JP); Toyohiko Kumada, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 280 days.

(21) Appl. No.: 10/315,942

(22) Filed: Dec. 11, 2002

(65) Prior Publication Data

US 2003/0107320 A1 Jun. 12, 2003

(30) Foreign Application Priority Data

Dec. 12, 2001 (JP) ..... 2001-378676

(51) Int. Cl.[7] ..... H01J 17/18; H01J 61/36

(52) U.S. Cl. ..... 313/623; 313/625; 313/318.07; 313/635

(58) Field of Search ..... 313/623, 624, 313/625, 634, 635, 618

(56) References Cited

U.S. PATENT DOCUMENTS

| | | | | |
|---|---|---|---|---|
| 5,109,181 A | | 4/1992 | Fischer et al. | |
| 5,430,353 A | * | 7/1995 | Feldman et al. | 313/623 |
| 5,497,049 A | | 3/1996 | Fischer | |
| 6,135,840 A | | 10/2000 | Kanzaki | |
| 6,538,383 B1 | * | 3/2003 | Takeuchi | 313/635 |
| 2002/0031975 A1 | | 3/2002 | Kanzaki et al. | |

FOREIGN PATENT DOCUMENTS

| | | | | |
|---|---|---|---|---|
| EP | 0 635 866 A1 | | 1/1995 | |
| EP | 1 067 581 A2 | | 1/2001 | |
| JP | 07153436 A | * | 6/1995 | H01J/5/46 |
| JP | 10-284001 | | 10/1998 | |
| JP | 11067154 A | * | 3/1999 | H01J/61/36 |
| JP | 11-111226 | | 4/1999 | |
| JP | 2000123786 A | * | 4/2000 | H01J/61/20 |
| JP | 2001-118542 | | 4/2001 | |

OTHER PUBLICATIONS

Patent Abstracts of Japan vol. 1996, No. 12, Dec. 26, 1996 & JP 08 212978 A (Toshiba Lighting & Amp; Technol Corp.) Aug. 20, 1996.

Patent Abstracts of Japan vol. 1999, No. 04, Apr. 30, 1999 & JP 11 016539 A (Seiko Epson Corp), Jan. 22, 1999.

European Search Report Dated Aug. 29, 2003.

* cited by examiner

*Primary Examiner*—Vip Patel
*Assistant Examiner*—Mariceli Santiago
(74) *Attorney, Agent, or Firm*—Nixon Peabody LLP; David S. Safran

(57) ABSTRACT

To reduce and prevent electrode displacement and at the same time to devise an arrangement of the side tube parts with high adhesion, a short-arc, ultra-high pressure discharge lamp a light emmitting part in which there is a pair of opposed electrodes and which is filled with at least 0.15 mg/mm$^3$ of mercury is provided with side tube parts which extend from opposite sides of the light emitting part in which the electrodes are partially hermeticallly sealed and in which the electrodes are each welded in a central valley of a metal foil that has a cross section with an essentially inverted W-shape. The valley and flanking arches or peaks of the W-shape may be sarpentine or sinusoidal, trapezoidal, or rectangular in addition to the traditional W-shape having acutely angled corners between straight legs.

10 Claims, 6 Drawing Sheets

| Lamp | Electrode distance | Eccentricity |
|---|---|---|
| 1 | 1.12 | 0.32 |
| 2 | 1.04 | 0.37 |
| 3 | 1.09 | 0.07 |
| 4 | 1.05 | 0.38 |
| 5 | 1.08 | 0.33 |
| 6 | 1.07 | 0.38 |
| 7 | 0.99 | 0.39 |
| 8 | 1.01 | 0.00 |
| 9 | 1.08 | 0.24 |
| 10 | 1.00 | 0.08 |
| Mean value | 1.05 | 0.26 |

Fig.8(a)

| Lamp | Electrode distance | Eccentricity |
|---|---|---|
| 1 | 0.98 | 0.30 |
| 2 | 0.66 | 0.28 |
| 3 | 0.72 | 0.66 |
| 4 | 0.82 | 0.32 |
| 5 | 0.89 | 0.58 |
| 6 | 0.68 | 0.59 |
| 7 | 0.76 | 0.10 |
| 8 | 0.69 | 0.76 |
| 9 | 0.92 | 0.56 |
| 10 | 0.58 | 0.65 |
| Mean value | 0.77 | 0.48 |

Fig.8(b)

| Lamp | Pressure tightness (relative value) |
|---|---|
| 1 | 172 |
| 2 | 133 |
| 3 | 156 |
| 4 | 126 |
| 5 | 186 |
| 6 | 135 |
| 7 | 141 |
| 8 | 120 |
| 9 | 125 |
| 10 | 135 |
| Mean value | 143 |

| Lamp | Pressure tightness (relative value) |
|---|---|
| 1 | 100 |
| 2 | 103 |
| 3 | 88 |
| 4 | 111 |
| 5 | 95 |
| 6 | 110 |
| 7 | 90 |
| 8 | 107 |
| 9 | 97 |
| 10 | 114 |
| Mean value | 101 |

SHORT-ARC, ULTRA-HIGH PRESSURE DISCHARGE LAMP

BACKGROUND OF THE INVENTION

1. Field of the Invention

The invention relates to a short-arc, ultra-high pressure discharge lamp in which the mercury vapor pressure during operation is at least 150 atm. The invention also relates especially to a short-arc, ultra-high pressure discharge lamp which is used as the back light of a liquid crystal display device and a projector device using a DMD (digital mirror device), like a DLP (digital light processor) or the like.

2. Description of the Prior Art

In a projector device of the projection type, there is a demand for illumination of the images uniformly onto a rectangular screen with sufficient color reproduction. Thus, a metal halide lamp which is filled with mercury and a metal halide is used as the light source. Furthermore, recently smaller and smaller metal halide lamps and more and more often spot light sources have been produced and lamps with extremely small distances between the electrodes have been used in practice.

Against this background, recently, instead of metal halide lamps, lamps with an extremely high mercury vapor pressure, for example, with 150 atm, have been proposed. Here, the increased mercury vapor pressure suppresses broadening of the arc (the arc is compressed) and a major increase of the light intensity is desired. One such ultra-high pressure discharge lamp is disclosed in JP-OS HEI 2-148561 (corresponding to U.S. Pat. No. 5,109,181) and JP-OS HEI 6-52830 (corresponding to U.S. Pat. No. 5,497,049).

These ultra-high pressure discharge lamps have a light emitting part in which there are a pair of electrodes, and side tube parts on opposite ends thereof. In the respective side tube part, one end of the electrode and a metal foil are welded to one another. Due to the demand for reducing the size of lamps and for a spot light source, there is a demand for an electrode with an upholding part with a small outside diameter, for example, from 0.2 mm to 1.0 mm, and furthermore, a demand for an extremely small electrode distance, i.e., an extremely small arc length, for example, of roughly 0.5 mm to 2.0 mm.

FIGS. 6(*a*) & 6(*b*) each schematically show the arrangement of the tip area of the electrode, enlarged. Here, there are a cathode 11 and an anode 12 opposite at a small distance from one another. Between the two electrodes, an arc bright spot P is formed. However, as is shown in FIG. 6(*b*), there arc cases in which the cathode 11' is shifted (the position deviates from a given position). In this case, the distance to the anode 12 is increased, i.e., the distance between the electrodes. In addition, the position of the arc bright spot P' changes. Such a change of the electrode distance and the position of the arc bright spot reduces the efficiency of the light to a large degree because a projector device or the like is optically engineered based on given adjustment values.

FIGS. 7(*a*) & (*b*) each schematically show the electrode displacement. FIG. 7(*a*) shows the state in which the cathode on the metal foil is shifted during resistance welding of the cathode 11 to the metal foil 13, due to contact of the welding rod with the cathode or the metal foil. Since the diameter of the cathode is 0.2 mm to 1.0 mm, therefore, is extremely small, as was described above, the cathode often moves during contact with the welding rod. FIG. 7(*b*) shows the state in which the cathode tip is also shifted as a result of bending of the metal foil itself. This occurs in a process in which the electrode assembly, after resistance welding of the metal foil to the cathode, is hermetically scaled in silica glass. The metal foil bends due to the flow property of the silica glass in the molten state. This description above relates above to the cathode, but it likewise applies to the anode.

The above described disadvantage which occurs due to shifting of the electrode tip is disadvantageous in a discharge lamp with an extremely small electrode distance of 0.5 mm to 2.0 mm. In a discharge lamp with a large electrode distance, for example of at least 5 mm, it never develops into a major disadvantage, e.g., the arc bright spot being shifted or the like, even if the electrode tip is more or less shifted.

In an ultra-high pressure discharge lamp as the light source of a projector device of the projection type, the amount of light decreases to a large degree even with a small electrode displacement. In this respect, there is a completely new task which never occurs in a conventional discharge lamp.

Since in such an ultra-high pressure discharge lamp the pressure within the arc tube becomes extremely high during operation, it is necessary to place the silica glass comprising these side tubes parts, the electrodes and metal foils in a sufficient amount, and moreover, directly and tightly adjoining one another in a secure manner in the side tube parts which extend from opposite sides of the arc tube. If they are not relatively tightly adjoining one another, the added gas escapes or cracks form.

SUMMARY OF THE INVENTION

A primary object of the present invention is to reduce and prevent electrode displacement in a short-arc, ultra-high pressure mercury lamp with an extremely small electrode distance of 0.5 mm to 2.0 mm and a pressure within the arc tube of at least 150 atm during operation, and at the same time, to devise an arrangement of the side tube parts with good adhesive properties.

This object is achieved in accordance with the invention in a short-arc, ultrahigh pressure discharge lamp which comprises the following:

a light emitting part in which there are a pair of opposed electrodes and which is filled with at least 0.15 $mg/mm^3$ mercury, and side tube parts which extend from opposite sides of the light emitting part, in which the electrodes are partially hermetically sealed, and in which the electrodes and the metal foils are joined to one another, in that the above described respective metal foil has a cross section of an essentially inverted W-shape and that the respective electrode is located and welded in the middle valley area of an essentially inverted W shape of the respective metal foil.

The object is furthermore achieved in accordance with the invention in that the maximum height of the middle valley area of the metal foil with an essentially inverted W shape is 0.2 mm to 1.0 mm, when the diameter of the above described electrode is 0.2 mm to 1.0 mm and the outside diameter of the respective side tube part is 4.0 mm to 9.0 mm.

The invention is further described below using several embodiments shown in the drawings.

BRIEF DESCRIPTION OF THE DRAWINGS

FIGS. 8(*a*) and 8(*b*) show tables of experimental results with respect to the present invention and the prior art, respectively;

FIGS. 9(*a*) & 9(*b*) show tables of experimental results in the invention with respect to the present invention and the prior art, respectively.

DETAILED DESCRIPTION OF THE INVENTION

Figure 1:
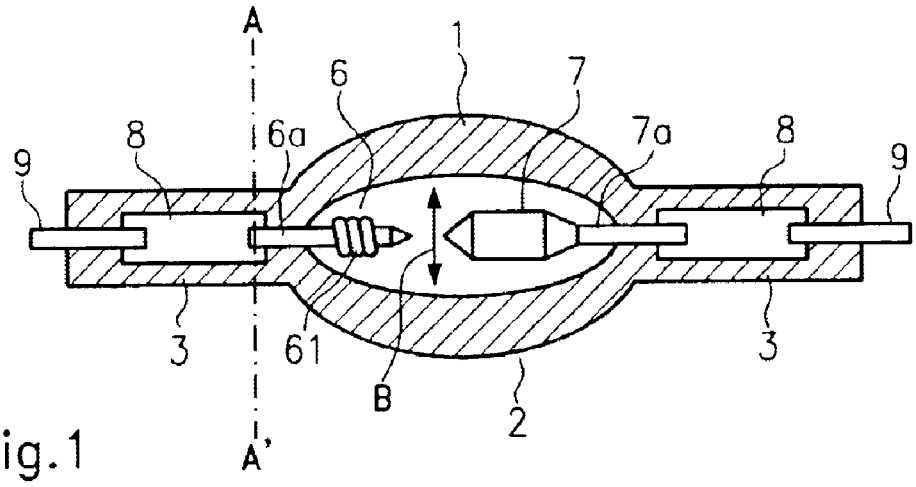
FIG. 1 shows an overall view of a short-arc, ultra-high pressure discharge lamp in accordance with the invention.

FIG. 1 shows the overall arrangement of a short-arc, ultra-high pressure discharge lamp (hereinafter also called only a "discharge lamp") in accordance with the invention. In the figure, the discharge lamp 1 has an essentially rugbyball-shaped (i.e., generally ellipsoid-shaped) light emitting part 2 which is formed from a silica glass discharge vessel.

Within the light emitting part 2, there are an opposed cathode 6 and anode 7. A side tube part 3 extends from each of opposite ends of the light emitting part 2, and a conductive metal foil 8, which normally is made of molybdenum, is hermetically sealed within each side tube part 3, for example, by a pinch seal. The ends of the electrode rods 6*a*, 7*a* which have the cathode 6 or the anode 7 on their tip are each located welded onto one end of a respective metal foil 8 so as to be electrically connected thereto. An outer lead 9, which projects to the outside, is welded to the other end of the respective metal foil 8. There are cases in which the cathode 6 and the anode 7 each have at a tip part with an increased diameter, and also a case in which they do not have a part with an increasing diameter at the respective tip. Furthermore, there are also cases in which the electrode includes the electrode rods 6*a*, 7*a* as part thereof. The term "electrode" as used herein is intended to encompass all such cases. The light emitting part 2 is filled with mercury, a rare gas, and if necessary, also a halogen gas.

The mercury is used to obtain the desired wavelengths of visible radiation, for example, radiant light with wavelengths from 360 to 780 mm, and is added in an amount of at least 0.15 mg/mm$^3$, for example, of 0.17 mg/mm$^3$, 0.20 mg/mm$^3$, 0.25 mg/mm$^3$, or 0.30 mg/mm$^3$. The values given here are for filling at room temperature and relate to the inside volume of the arc tube in mm$^3$. This added amount also differs depending on the temperature condition. However, during operation, a pressure of at least 150 atm, therefore an extremely high vapor pressure, is reached. By adding a larger amount of mercury, a discharge lamp with a high mercury vapor pressure during operation of at least 200 atm or at least 300 atm can be produced. The higher the mercury vapor pressure, the more suitable will the lamp be for use as a light source for a projector device.

For example, roughly 13 kPa argon gas is added as the rare gas, by which the operation starting property is improved.

Iodine, bromine, chlorine, and the like in the form of a compound with mercury and other metals are added as the halogen. The amount of halogen added can be selected, for example, from the range of $10^{-6}$ to $10^{-2}$ $\mu$mol/mm$^3$. The function of the halogen is to prolong the service life using the halogen cycle. For an extremely small discharge lamp with a high inner pressure, like the discharge lamp according to the invention, by adding halogen in this way, blackening and devitrification of the discharge lamp can be prevented.

The numerical values of one such discharge lamp are given below by way of example:

- the maximum outside diameter of the light emitting part 2 is in the diameter range from 6.0 mm to 15.0 mm is 9.5 mm;
- the distance between the electrodes in the range from 0.5 mm to 2.0 mm is 1.5 mm;
- the inside volume of the arc tube in the range from 40 mm$^3$ to 200 mm$^3$ is 75 mm$^3$;
- the nominal voltage is 80 V and the nominal wattage 150 W as operating conditions.

This short-arc, ultra-high pressure discharge lamp is located in a small projector device or the like. On the one hand, the overall arrangement is very small but, on the other hand, there is a need for a large amount of light. The thermal conditions within the light emitting part are therefore extremely strict, i.e., the value of the wall load is 0.8 W/mm$^2$ to 2.0 W/mm$^2$, specifically 1.5 W/mm$^2$. The lamp is installed in the above described projector device or in a presentation apparatus, such as an overhead projector, and can offer radiant light with good color reproduction.

Figure 2A:
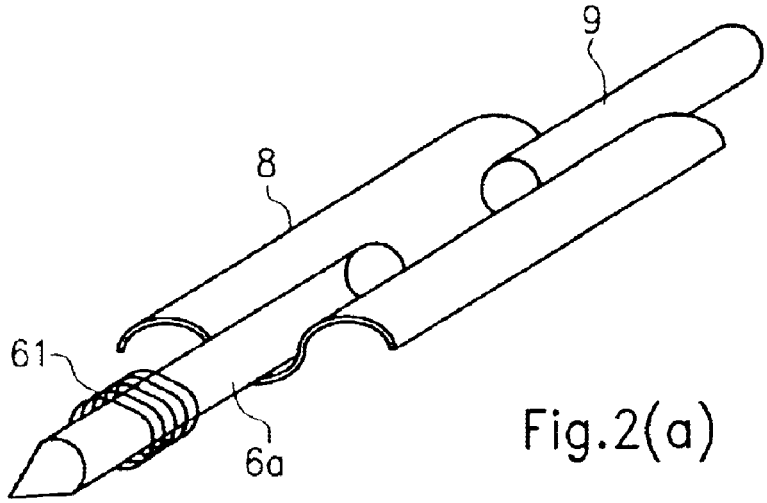
FIG. 2(*a*) shows a schematic of the electrode assembly of a metal foil of a short-arc, ultra-high pressure discharge lamp according to the invention and FIG. 2(*b*) shows the metal foil of the FIG. 2(*a*) assembly.
Figure 2B:
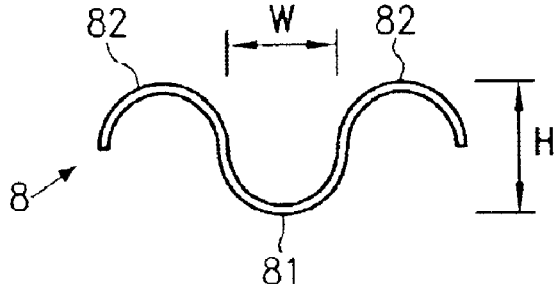

FIG. 2(*a*) shows an electrode assembly having an electrode rod 6*a*, a metal foil 8 and an outer lead 9. FIG. 2(*b*) shows the cross sectional shape of the metal foil 8. The metal foil 8 has an essentially inverted W shape (in spite of the arc shape), the term inverted W-shape being intended to encompass the serpentine or sinusoidal shape having two arches or peaks 82 and an interposed valley or trough 81 as shown in FIG. 2(*b*), in addition to the traditional W shape shown in FIG. 5(*c*) and the trapezoidal and rectangular wave shapes of FIGS. 5(*a*) and 5(*b*) as well as other comparable peak and valley shapes. The electrode rod 6*c* and the outer lead 9 are each located in the middle valley area 81 and are welded to the metal foil.

In this cross sectional shape, the electrode rod 6*a* advantageously sits in the middle of the valley area 81 of the metal foil 8, even if, when the electrode rods 6*a* are welded to the metal foil, a welding rod is pressed against both. The undesirable displacement which is described with reference to the prior art, therefore, does not occur. The width W of the central valley area 81 is 0.2 mm to 1.0 mm and its height H is 0.2 mm to 1.0 mm, as is described below.

Figure 3:
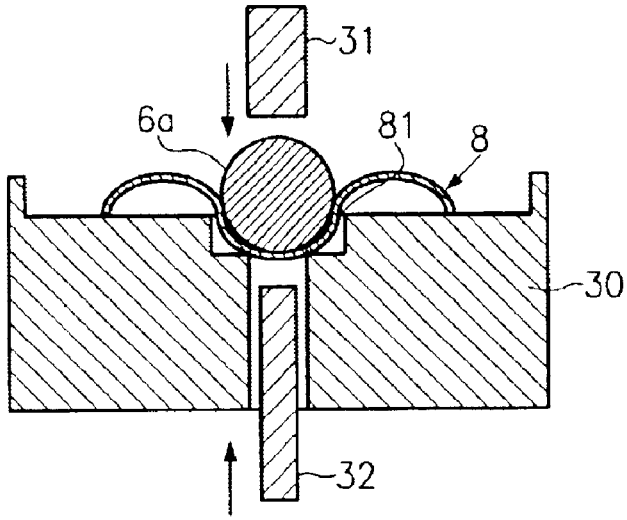
FIG. 3 shows a schematic of the welding state using a metal foil in accordance with the invention.

FIG. 3 shows the state in which the electrode rod 6*a* is welded to the metal foil 8 by resistance welding. The electrode rod 6*a* and the metal foil 8 are located in a template 30 which has a given shape, and resistance welding is performed by pressing the upper welding rod 31 and the lower welding rod 32 against the electrode rod 6 and the metal foil 8. The reason why the lower welding rod 32 is thinner is to make the welding area smaller because it is desirable for the welding area to be at most 0.3 $mm^3$. The reason for this is the following:

When the electrode rod is welded to the metal foil by resistance welding, in the area in which they are welded to one another, a state is produced in which the tungsten of the electrode rod is alloyed with the molybdenum of the metal foil. Since this alloyed state has a coefficient of thermal expansion which is different from that of the molybdenum in the vicinity of the weld area, the so-called foil floating phenomenon occurs in this weld area.

When the two welding rods 31, 32 are pressed, the electrode rod 6*a* is advantageously held in the valley area 81 in the middle of the metal foil 8 with an inverted W shape. Thus, displacement of the electrode rod 6*a* can be prevented.

Not only the electrode rod, but also the outer lead can be placed in the valley area of the metal foil. This has the same effect as in the electrode rod.

In the above described embodiment, the cathode rod was described. However, the invention, of course, is not limited to the cathode rod, the invention also being usable for the anode rod.

The adhesion to the silica glass by using the metal foil with the inverted W shape is described below.

Figure 4A:
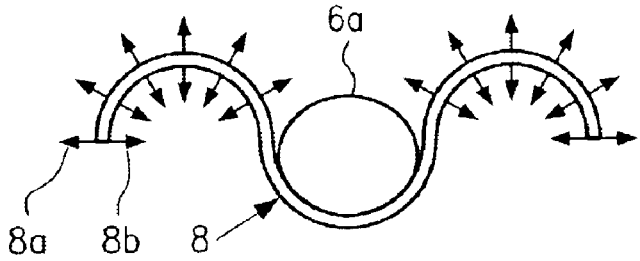
FIGS. 4(*a*) & 4(*b*) each show a schematic of the voltage distribution in a metal foil, FIG. 4(*a*) being an arrangement with a metal foil according to the invention and FIG. 4(*b*) being with a conventional, plate-shaped metal foil.
Figure 4B:
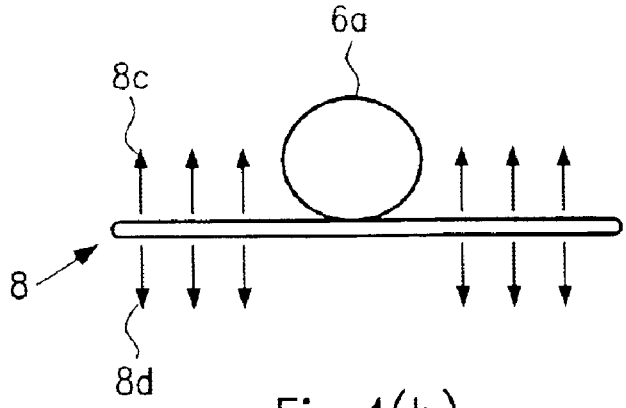

FIGS. 4(*a*) and 4(*b*) each show formation of stress in hermetic sealing of a metal foil in the silica glass. Only the metal foil and electrode rod, and not the silica glass, is shown. FIG. 4(*a*) shows the case of using a metal foil in accordance with the invention using a foil with an inverted W shape. FIG. 4(*b*) shows the case of a conventional, plate-shaped metal foil.

Since the metal foils in the two figures are hermetically sealed by silica glass, in the direction perpendicular to the respective metal foil, stress forms (shown using arrows). The stress forms because the coefficient of expansion of the silica glass and the coefficient of expansion of the molybdenum differ from one another by at least one order of magnitude.

In this case, in FIG. 4(*a*), for the molybdenum foil 8, a stress shown using arrows 8*a* and a stress shown using arrows 8*b* are formed. They act in the directions in which they cancel stresses from other locations. The adhesive property of the metal foil on the silica glass in the vicinity thereof is therefore maintained overall. However, in FIG. 4(*b*), the stress which forms in the molybdenum foil and which is shown using arrows 8*c* and the stress which is shown using arrows 8*d* do not cancel stresses from other locations. Between the metal foil (molybdenum foil) and the silica glass, the adhesive property is adversely affected; this leads to formation of cracks when the extremely high pressure of the discharge space acts on these locations.

Figure 5A:
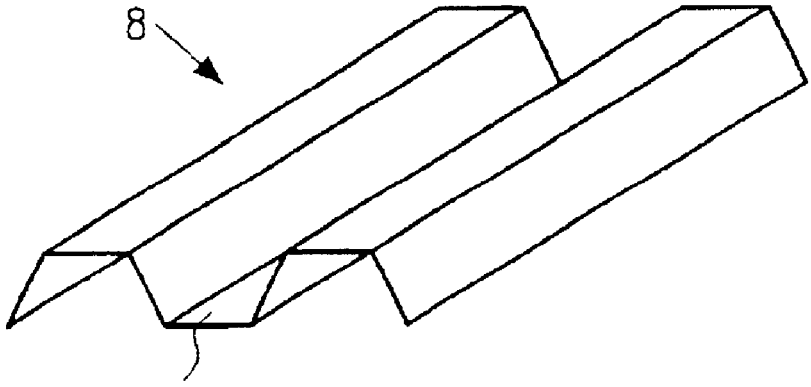
FIGS. 5(*a*) to 5(*c*) each show a schematic of another embodiment of the metal foil in accordance with the invention.
Figure 5B:
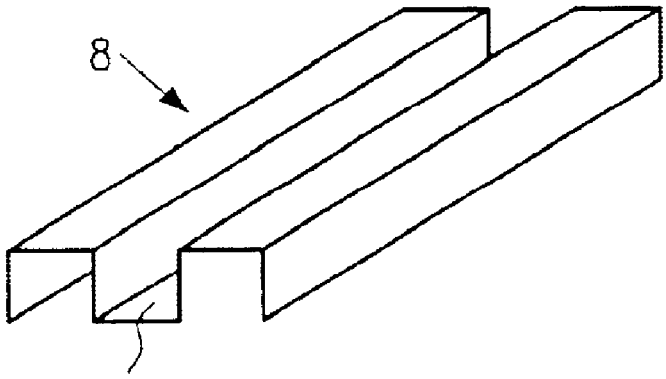
Figure 5C:
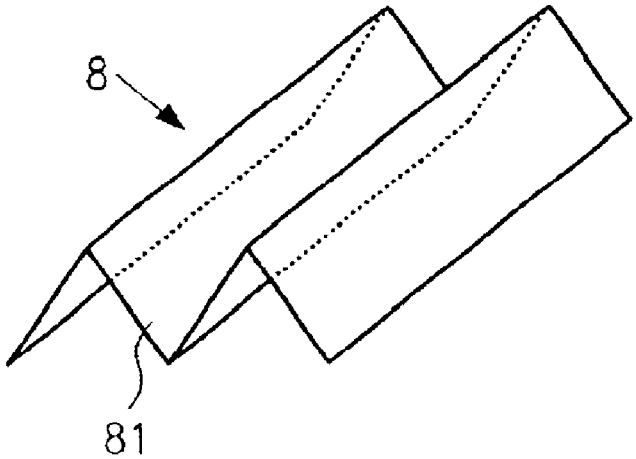
Figure 6A:
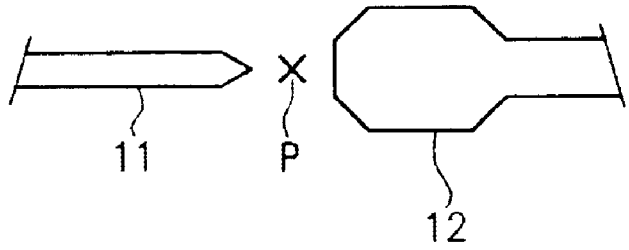
Fig.6(a) (Prior Art)
FIGS. 6(*a*) & 6(*b*) each show a schematic of the state of electrode displacement in a prior art arrangement.
Figure 6B:
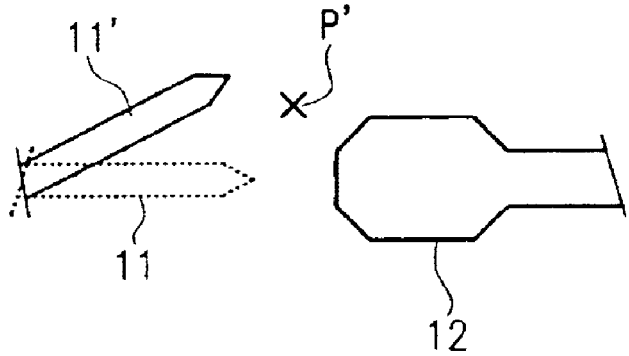
Fig.6(b) (Prior Art)
Figure 7A:
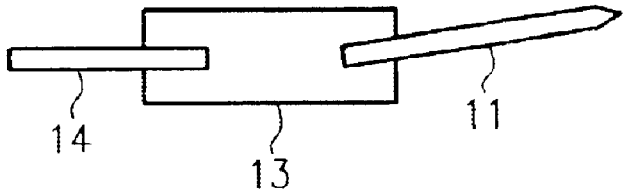
Fig.7(a) (Prior Art)
FIGS. 7(*a*) & 7(*b*) each show a schematic of the state of electrode displacement in a prior art arrangement.
Figure 7B:
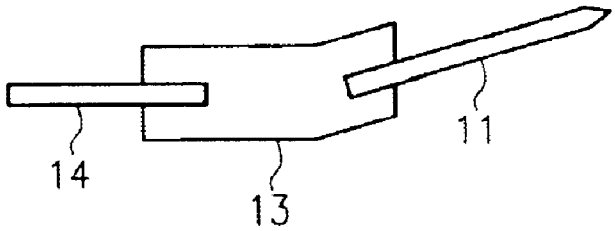
Fig.7(b) (Prior Art)

FIGS. 5(*a*) to 5(*c*) each show another embodiment of a metal foil with an inverted W shape.

In FIG. 5(*a*), the central valley area 81 is trapezoidal. The arched areas 82 on opposite sides thereof are also trapezoidal.

In FIG. 5(*b*), the central valley area 81 is rectangular. The arched areas 82 on opposite sides thereof are also rectangular.

In FIG. 5(*c*), the central valley area 81 is sharp-cornered as are the arched areas 82 on opposite sides thereof. Thus, the foil 8 has a traditional W shape in cross section that has been inverted.

It is sufficient if the cross section of the metal foil of the invention has any essentially inverted W shape, including a wave shape as shown in FIGS. 2(*a*) and 2(*b*), the above described trapezoidal shape, the above described rectangular shape, or a traditional W shape, and also other shapes as was noted above. The valley area 81 in the middle of the metal foil of the invention is absolutely necessary for the purposes of arrangement of the electrode rod, and the arched areas 82 on opposite sides of the valley area are necessary for purposes of balancing during welding.

Furthermore, the sides of the ached areas 82 can be provided with other shapes when such an essentially inverted W shape is partially present.

In a short-arc, ultra-high pressure discharge lamp which is used as a light source of a projector device, the outside diameter of the respective side tube part, the outside diameter of the respective electrode rod, the inner volume of the arc tube and the like are to a certain extent limited. Generally, the outside diameter of the respective side tube part is 4.0 mm to 9.0 mm and the outside diameter of the respective electrode rod is 0.2 mm to 1.0 mm. For such a shape and for this size, it is effective that the height H of the valley area of the metal foil of the invention is 0.2 mm to 1.0 mm and the width W is 0.2 mm to 1.0 mm. The reason for this is that there is no contact with the welding rod in resistance welding and therefore the metal foil is not scratched when the height H of the valley area of the metal foil is at most equal to the outside diameter of the electrode rod.

The results of tests performed are described below; the results show that the metal foil arrangement in accordance with the invention has better position stability and a better adhesive property to silica glass than the conventional arrangement.

In particular, ten discharge lamps using the metal foil in accordance with the invention with an inverted W shape (with the arrangement shown in FIGS. 2(*a*) and 2(*b*)) and ten discharge lamps using the conventional, plate-shaped metal foil were used and tests were run. All 20 lamps were the same except for the different physical configurations of the metal foils. This means that the outside diameter of the electrode rod was 0.3 mm, the outside diameter of the side tube part was 6.0 mm, the calculated data of the distance between the electrodes were 1.1 mm and the inner volume of the arc tube was 116 $mm^3$.

For the distance between the electrodes, the shortest distance between the cathode tip and the anode tip was measured. The eccentricity represents the difference in distance between the two electrode tips in the direction perpendicular to the lengthwise direction of the lamp (direction B in FIG. 1).

FIGS. 8(*a*) and 8(*b*) show the results. In the discharge lamp using the metal foil in accordance with the invention, the average electrode distance is 1.05 mm, its maximum value is 1.12 mm and its minimum value is 0.99 mm, while in the discharge lamps using the conventional metal foil, the average electrode distance is 0.77 mm, its maximum value is 0.98 mm and its minimum value is 0.58 mm. This shows that the variance of the indicated values is extremely small for the discharge lamps using the metal foil of the invention.

Besides the above described test, for a test with respect to the adhesive property, a state was induced in which the electrode assembly of only one of the side tube parts is hermetically sealed and in which the other side tube part is continuously connected to the discharge space without inserting the electrode assembly. There were likewise ten semi-finished products using the metal foil in accordance with the invention having an inverted W shape (with the arrangement shown in FIGS. 2 (*a*) and 2(*b*)) and ten semi-finished products using the conventional, plate-shaped metal foil. In the tests, liquid alcohol was injected into the respective semi-finished products through the opening of the other side tube part, the injection pressure was measured when the side tube part was destroyed on the side in which the electrode assembly is hermetically sealed, and an evaluation was performed. The respective numerical value is a relative value, the injection pressure being designated 100 when lamp number 1 of the conventional product was destroyed.

FIGS. 9(*a*) and 9(*b*) show the results. For the semi-finished products using the metal foil in accordance with the invention the average of the relative values is 143, its maximum value is 186 and its minimum value is 120, while for the semi-finished product using the conventional metal foil, the average of the relative values is 101, its maximum value is 114 mm and its minimum value is 88. This shows that by using the metal foil of the invention, by the above described logic, the adhesion of the metal foil to the silica glass is increased and that, as a result, the pressure tightness increases enormously.

Figures 9A, 9B, 10:
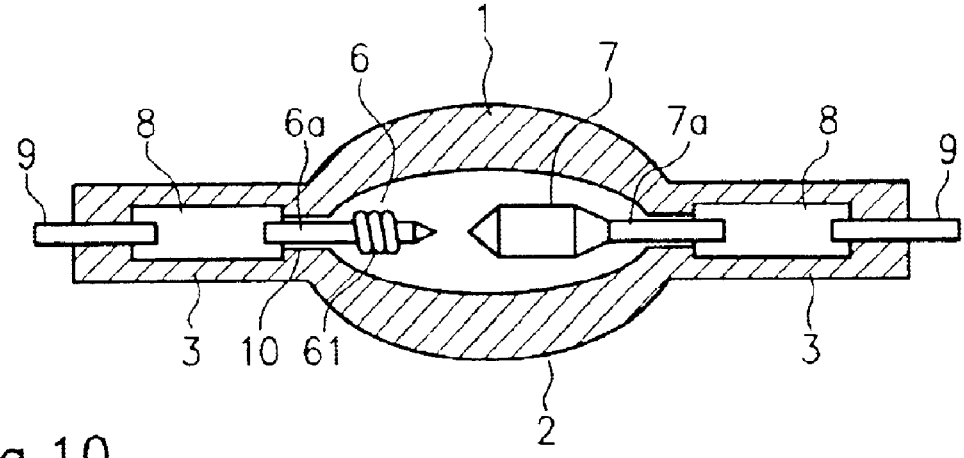
FIG. 10 shows a schematic of another embodiment of a short-arc, ultra-high pressure discharge lamp in accordance with the invention.

The applicant has already proposed a discharge lamp in which an extremely small gap is formed between the electrode rod and the side tube part in commonly-owned, co-pending U.S. patent application Ser. No. 09/874,231. FIG. 10 schematically shows the discharge lamp of that patent application. The light emitting part is filled with at least 0.15 mg/mm$^3$ mercury and a gap 10 is formed in the side tube part 3 on the outside surfaces of the cathode rod 6*a* and the anode rod 7*a*. The reason for formation of the gap 10 is the following:

When the tungsten comprising the electrode rod and the silica glass comprising the side tube part adhere to one another, there the danger that, as a result of the difference between the two coefficients of expansion, cracks will form after the process of hermetic sealing. The gap is formed in order to free the relative expansion of the two materials relative to one another. The width of the gap is roughly 5 microns to 20 microns.

In a discharge lamp with this arrangement, the high pressure of the emission part is applied directly to the connecting site between the electrode rod and the metal foil. Therefore, it is useful to use the arrangement of the metal foil of the present invention.

As was described above, in the short-arc, ultra-high-pressure discharge lamp in accordance with the invention, the metal foil which is hermetically sealed in the side tube part has an inverted W-shaped cross section. The following effects are obtained:

1. The displacement of the electrode rod is eliminated or reduced.
2. Adhesion of the foil to the quartz glass in the side tube part is improved.

What is claimed is:

1. Short-arc, ultra-high pressure discharge lamp which comprises:

a light emitting part in which there is a pair of opposed electrodes and which is filled with at least 0.15 mg/mm$^3$ of mercury; and side tube parts which extend from opposite sides of the light emitting part, and in each of which a respective one of the electrodes is partially hermetically sealed and is joined to a respective metal foil, wherein each metal foil has a cross section with an essentially inverted W-shape, and wherein each electrode is located and welded in a central valley area of the essentially inverted W shape of the respective metal foil, and wherein the central valley area has a maximum height of 0.2 mm to 1.0 mm, a portion of each electrode located in the valley area has a diameter of 0.2 mm to 1.0 mm and the outside diameter of each side tube part is 4.0 mm to 9.0 mm.

2. Short-arc, ultra-high pressure discharge lamp as claimed in claim 1, wherein the valley area of the essentially W-shaped cross section of the metal foil is rounded.

3. Short-arc, ultra-high pressure discharge lamp as claimed in claim 2, wherein the valley area of the essentially W-shaped cross section of the metal foil is flanked by rounded arched areas.

4. Short-arc, ultra-high pressure discharge lamp as claimed in claim 1, wherein the valley area of the essentially W-shaped cross section of the metal foil is trapezoidal.

5. Short-arc, ultra-high pressure discharge lamp as claimed in claim 4, wherein the valley area of the essentially W-shaped cross section of the metal foil is flanked by trapezoidal arched areas.

6. Short-arc, ultra-high pressure discharge lamp as claimed in claim 1, wherein the valley area of the essentially W-shaped cross section of the metal foil is rectangular.

7. Short-arc, ultra-high pressure discharge lamp as claimed in claim 6, wherein the valley area of the essentially W-shaped cross section of the metal foil is flanked by rectangular arched areas.

8. Short-arc, ultra-high pressure discharge lamp as claimed in claim 1, wherein the valley area of the essentially W-shaped cross section of the metal foil is formed by straight legs that are connected by an acutely-angled corner.

9. Short-arc, ultra-high pressure discharge lamp as claimed in claim 8, wherein the valley area of the essentially W-shaped cross section of the metal foil is flanked by arches formed by straight legs that are connected by an acutely-angled corner.

10. Short-arc, ultra-high pressure discharge lamp as claimed in claim 1, wherein the W-shape of the foil has a serpentine or sinusoidal shape in which the central valley is a trough formed between a pair of oppositely directed peaks.

* * * * *